US006638097B2

(12) United States Patent
Wu et al.

(10) Patent No.: US 6,638,097 B2
(45) Date of Patent: Oct. 28, 2003

(54) PROBE STRUCTURE

(76) Inventors: Jichen Wu, 11F-1.NO1.Sec2.Dungda Rd., Hsinchu (TW); Burton Yang, 11F-1.NO1.Sec2.Dungda Rd., Hsinchu (TW)

( * ) Notice: Subject to any disclaimer, the term of this patent is extended or adjusted under 35 U.S.C. 154(b) by 0 days.

(21) Appl. No.: 10/147,108

(22) Filed: May 15, 2002

(65) Prior Publication Data

US 2002/0187671 A1 Dec. 12, 2002

(30) Foreign Application Priority Data

Jun. 12, 2001 (CN) ..... 1226639 U

(51) Int. Cl.[7] ..... H01R 13/00
(52) U.S. Cl. ..... 439/482; 439/700; 439/824; 439/66
(58) Field of Search ..... 439/66, 700, 824, 439/482, 219

(56) References Cited

U.S. PATENT DOCUMENTS 5,600,883 A * 2/1997 Faure et al. ..... 29/846
6,305,969 B1 * 10/2001 Sato ..... 439/482
6,471,524 B1 * 10/2002 Nakano et al. ..... 439/70

FOREIGN PATENT DOCUMENTS

DE 3521012 A1 * 12/1985 ..... 439/482

* cited by examiner

*Primary Examiner*—Tho D. Ta
(74) *Attorney, Agent, or Firm*—Pro-Techtor International Services

(57) ABSTRACT

A probe structure for testing a to-be-tested object having at least one to-be-tested device. The probe is inserted into a pin hole formed on a pin board and contacts the to-be-tested device. The probe includes a probe body and a resilient member. The probe body has an insertion portion and a head contacting the to-be-tested device. The resilient member is placed within the pin hole of the pin board and has a top end and a bottom end. The top end is formed with a support portion contacting the insertion portion of the probe body when the probe body is inserted into the pin hole. Thus, the probe body can be elastically restored and properly guided.

1 Claim, 5 Drawing Sheets

PROBE STRUCTURE

BACKGROUND OF THE INVENTION

1. Field of the Invention

The invention relates to a probe structure, and more specifically to a probe structure using a combination of a probe body and a resilient member so that the probe body can elastically return to its initial state and can be automatically aligned or properly guided.

2. Description of the Related Art

In general, after traces are formed in printed circuit boards, the circuit boards have to be tested to make sure that each trace is normally conductive. After the test, the printed circuit boards having perfect electric traces are picked out for electrical elements to be mounted on.

Referring to FIG. 6, a conventional test jig for printed circuit boards includes a pin board 10, a plurality of probes 12 and middle boards 14. The pin board 10 is formed with pin holes 16 corresponding to the positions of to-be-tested devices 13 of a to-be-tested object 11 (a printed circuit board in this example). Each probe 12 is composed of a probe sleeve 18, a cylinder 20, a spring 22 and a probe body 24. The probe sleeve 18 is inserted into a predetermined pin hole 16 of the pin board 10 and has one end connected to a wire 19 for transmitting signals to a test machine (not shown). The spring 22 is received within the cylinder 20 into which the probe body 24 is inserted. According to the retractable force of the spring 22, the probe body 24 is retractable within the cylinder 20. Then, the cylinder 20 is mounted within the probe sleeve 18. Accordingly, the overall probe 12 is mounted on the pin board 10. The middle board 14 is also formed with middle holes 26 corresponding to the pin holes 16 of the pin board 10, respectively. The probe body 24 passes through a predetermined middle hole 26 of the middle board 14, projects over the middle board 14, and passes through a predetermined through hole 17 formed on a top board 15 located above the middle board 14.

Thereafter, a printed circuit board 11 is placed above the top board 15, and the test machine is used to make the to-be-tested device 13 of the printed circuit board 11 in contact with the probe body 24 of the probe 12. Then, electrical signals are in turn transferred to the spring 22, the probe sleeve 18, and the test machine via the wire 19 connected to the bottom of the probe sleeve 18. Next, the test machine judges whether or not the to-be-tested device can be turned on, and the test process of the printed circuit board 11 is thus completed.

The above-mentioned test method and the probe structure have the following drawbacks.

1. When the probe 12 contacts the to-be-tested device 13 of the to-be-tested object 11, the probe 12 has to possess retractable restoring force so that the electrical property of the to-be-tested device 13 can be free from being damaged. Therefore, the probe body 24 has to be placed within the cylinder 20 having the spring 22 mounted therein so as to automatically restore to its initial state before being compressed. In such a structure, the overall volume of the probe 12 cannot be easily made small. Thus, the manufacturing cost of the probe 12 is high when it is made very small, thereby increasing the testing cost. Accordingly, the test density cannot be effectively increased.

2. Since the size of the probe sleeve 18 has to mate with that of the probe 12, the size of the probe sleeve 18 is correspondingly limited and the overall test density of the pin holes 16 of the pin board 10 cannot be increased. Therefore, the circuit board 11 having to-be-tested devices 13 with a high density cannot be tested.

3. Since the electrical signals from the to-be-tested device 13 of the printed circuit board 11 are transferred via the contacts between the probe body 24 and the resilient member 22, between the resilient member 22 and the cylinder 20, and between the cylinder 20 and the probe sleeve 18, the phenomenon of poor signal transfer effect may occur after multiple contacts between such members. Thus, the test quality for the printed circuit board may be influenced, and especially poor in testing the to-be-tested devices with a high density.

4. Since the probe 12 is mounted on the pin board 10 and is not detachable, the pin board 10 and the probe 12 may not be used after a batch of printed circuit boards is tested. Therefore, the testing cost is increased and the source is wasted.

In view of this, the improved structure of the probe is provided to overcome the above-mentioned drawbacks.

SUMMARY OF THE INVENTION

It is therefore an object of the invention to provide an improved probe structure capable of facilitating the manufacturing processes and effectively lowering the manufacturing cost.

Another object of the invention is to provide a common test jig capable of testing to-be-tested devices with a high density and lowering the testing cost.

Still another object of the invention is to provide a common test jig capable of improving the testing conductivity and the testing result.

Yet still another object of the invention is to provide a common test jig, which can be recycled so that the manufacturing cost can be lowered.

Still another object of the invention is to provide an improved probe structure capable of aligning the probe so as to achieve a more precise testing result.

To achieve the above-mentioned objects, the invention provides a probe for testing a to-be-tested object having at least one to-be-tested device. The probe is inserted into a pin hole formed on a pin board and contacts the to-be-tested device. The probe includes a probe body and a resilient member. The probe body has an insertion portion and a head contacting the to-be-tested device. The resilient member is placed within the pin hole of the pin board and has a top end and a bottom end. The top end is formed with a support portion contacting the insertion portion of the probe body when the probe body is inserted into the pin hole. Thus, the probe body can be elastically restored and properly guided.

DETAILED DESCRIPTION OF THE PREFERRED EMBODIMENTS

Figure 1:
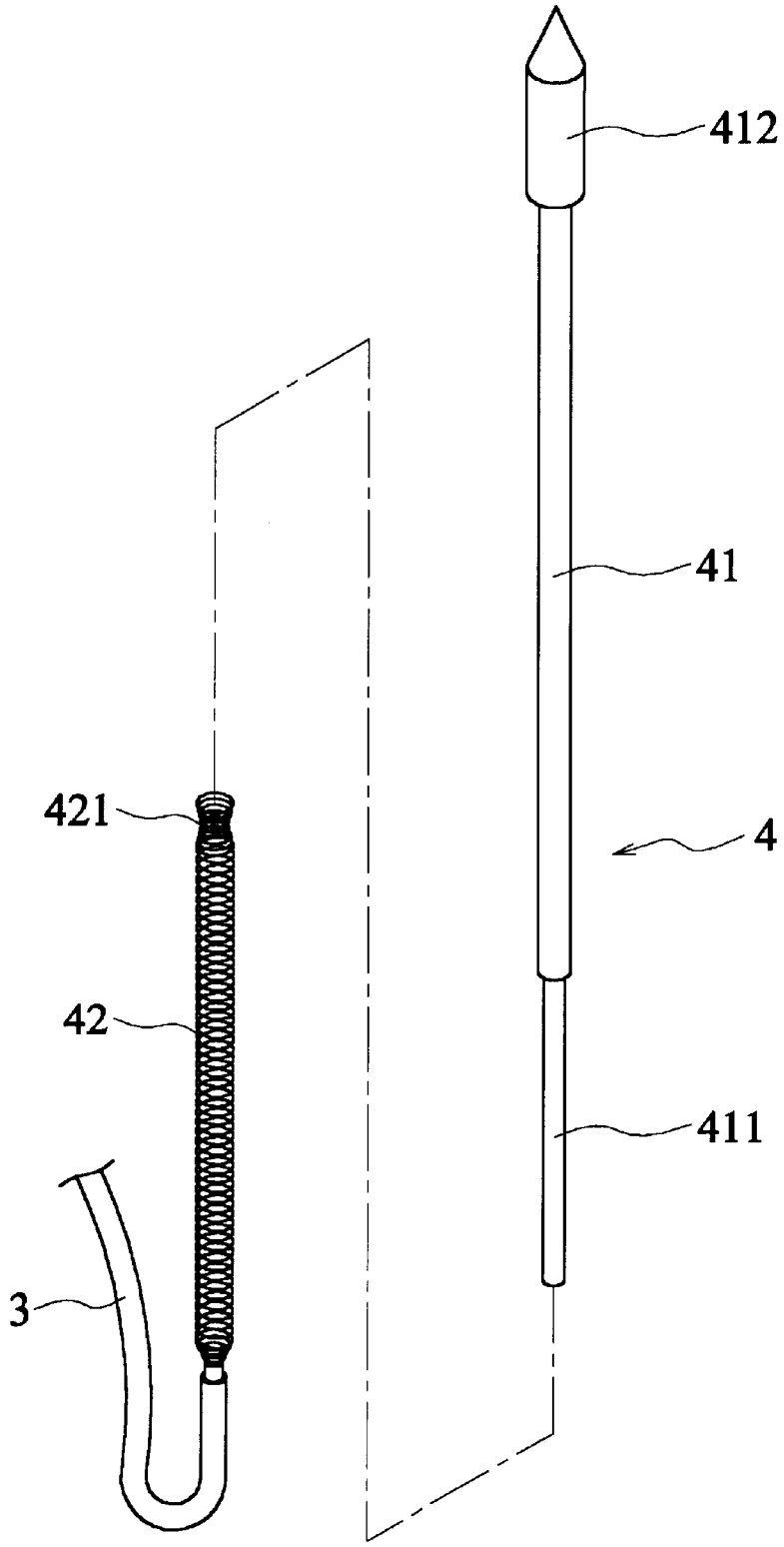
FIG. 1 is an exploded view showing the improved structure of the invention.

Referring to FIG. 1, the probe 4 of the invention includes a probe body 41 having an insertion portion 411, and a resilient member 42 having one end connected to a wire 3. The resilient member 42 has a bottom end and a top end formed with a bottleneck-shaped support portion 421 having diameter smaller than that of the insertion portion 411. The resilient member 42 may be a spring, and the support portion 421 may be integrally formed with the spring by winding the spring. The support portion 421 is electrically connected to the bottom of the insertion portion 411 of the probe body 41, and the resilient member 42 is connected to the wire 3.

Figure 2:
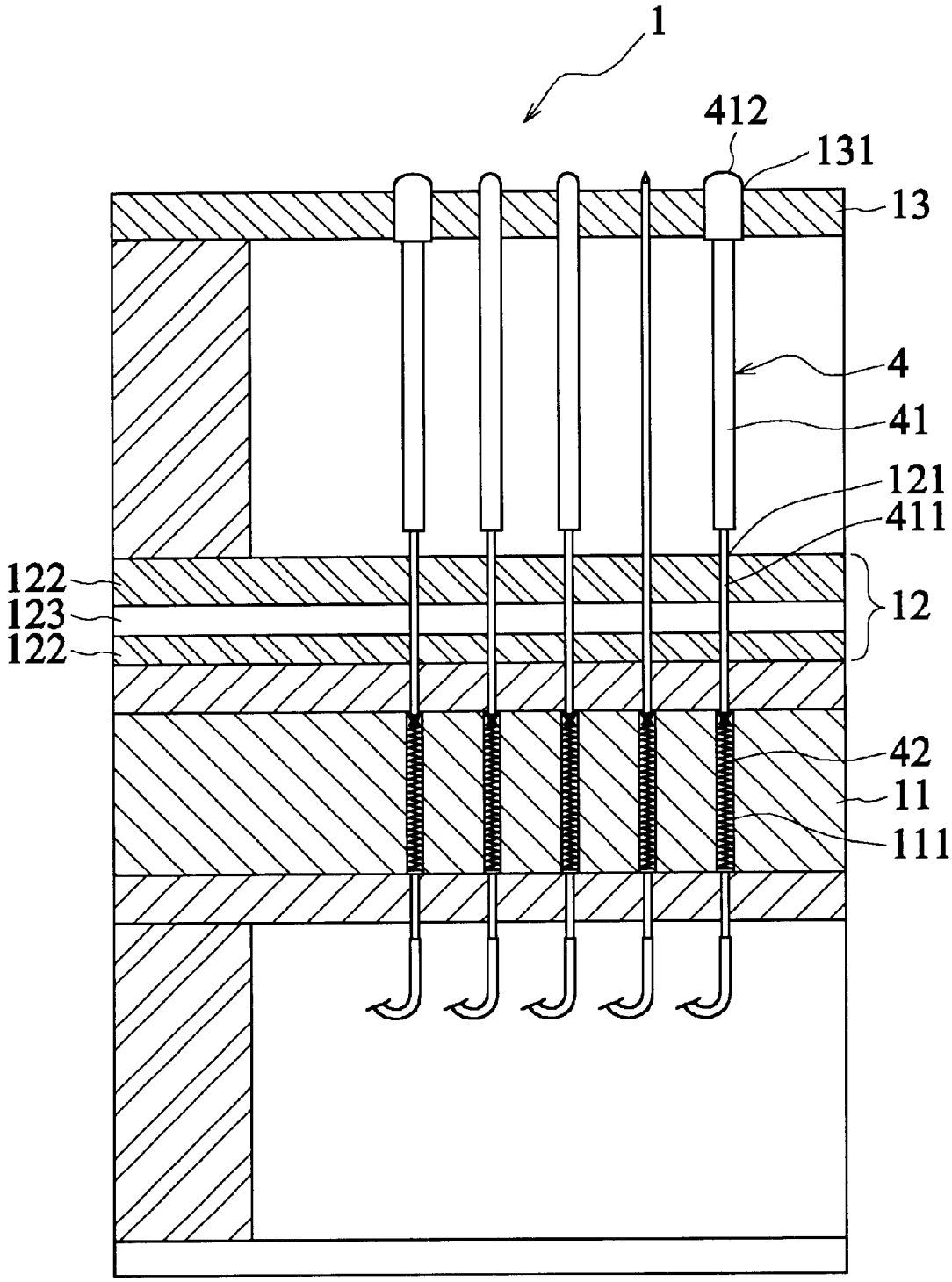
FIG. 2 is a cross-sectional view showing the improved combination structure of the probe of the invention.
Figure 3:
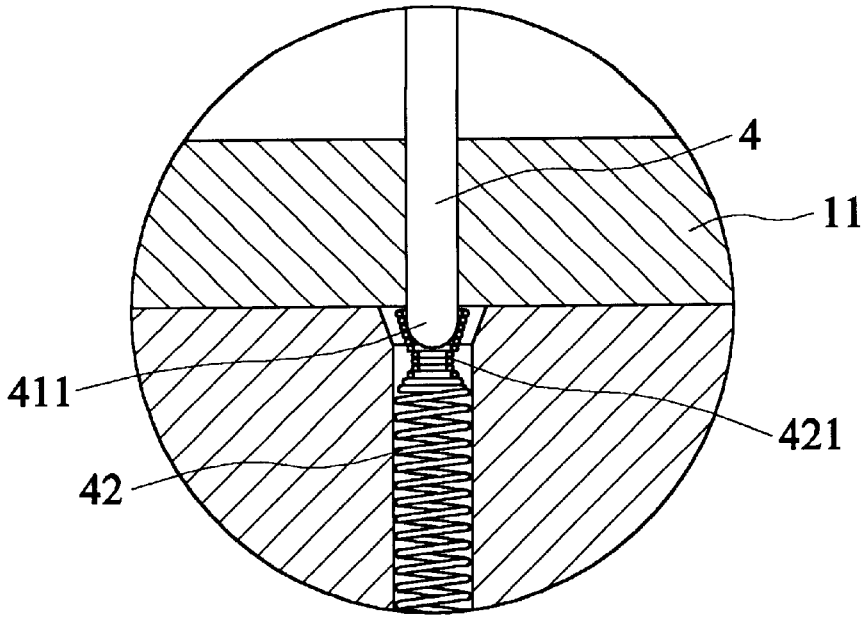
FIG. 3 is a schematic illustration showing a partial, enlarged cross-sectional view of the improved probe structure of the invention.

Referring to FIGS. 2 and 3, the probes 4 are mounted on the upper surface of the pin board 11 of the jig 1. The middle board 12 is stacked on the upper surface of the pin board 11. The middle board 12 is formed with several through holes 121 corresponding to the holes 111 of the pin board 11. The probe bodies 41 are inserted into the through holes 121 of the middle board 12 and has heads 412 projecting over the upper surface of the middle board 12 as well as the top board 13, which is located above the middle board 12. The through holes 131 of the top board 13 are configured according to the diameters of the corresponding heads 412 of the probe bodies 41. The middle board 12 includes two holding plates 122 and one flexible rubber plate 123 sandwiched between the two plates 122. The through holes of the middle board 12 are configured according to the insertion portions 411 at the ends of the probe bodies 41. In addition, the heads 412 of the probe bodies 41 have different diameters, while the ends of the probe bodies 41 are formed with the insertion portions 411 having a uniform specification. The insertion portions 411 may be inserted into the holes 111 of the pin board 11. The resilient members 42 are mounted within the holes 111. The top ends of the resilient members 42 are formed with bottleneck-shaped support portions 421 having diameters smaller than those of the insertion portions 411. The support portions 421 support the bottoms of the insertion portions 411 of the probe bodies 41. Meanwhile, the bottom ends of the resilient members 42 are directly connected to the wires 3.

Figure 5:
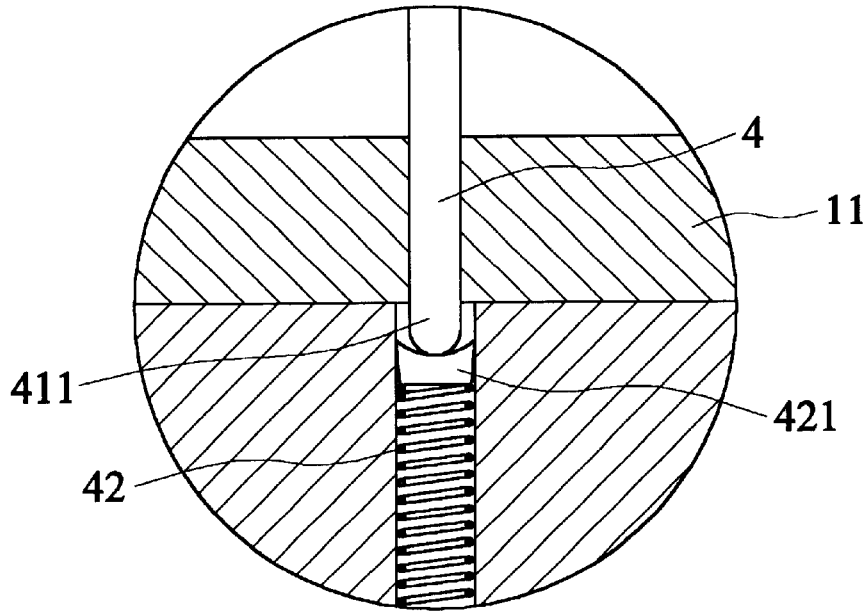
FIG. 5 is a schematic illustration showing a partial, enlarged cross-sectional view of FIG. 4.
Figure 4:
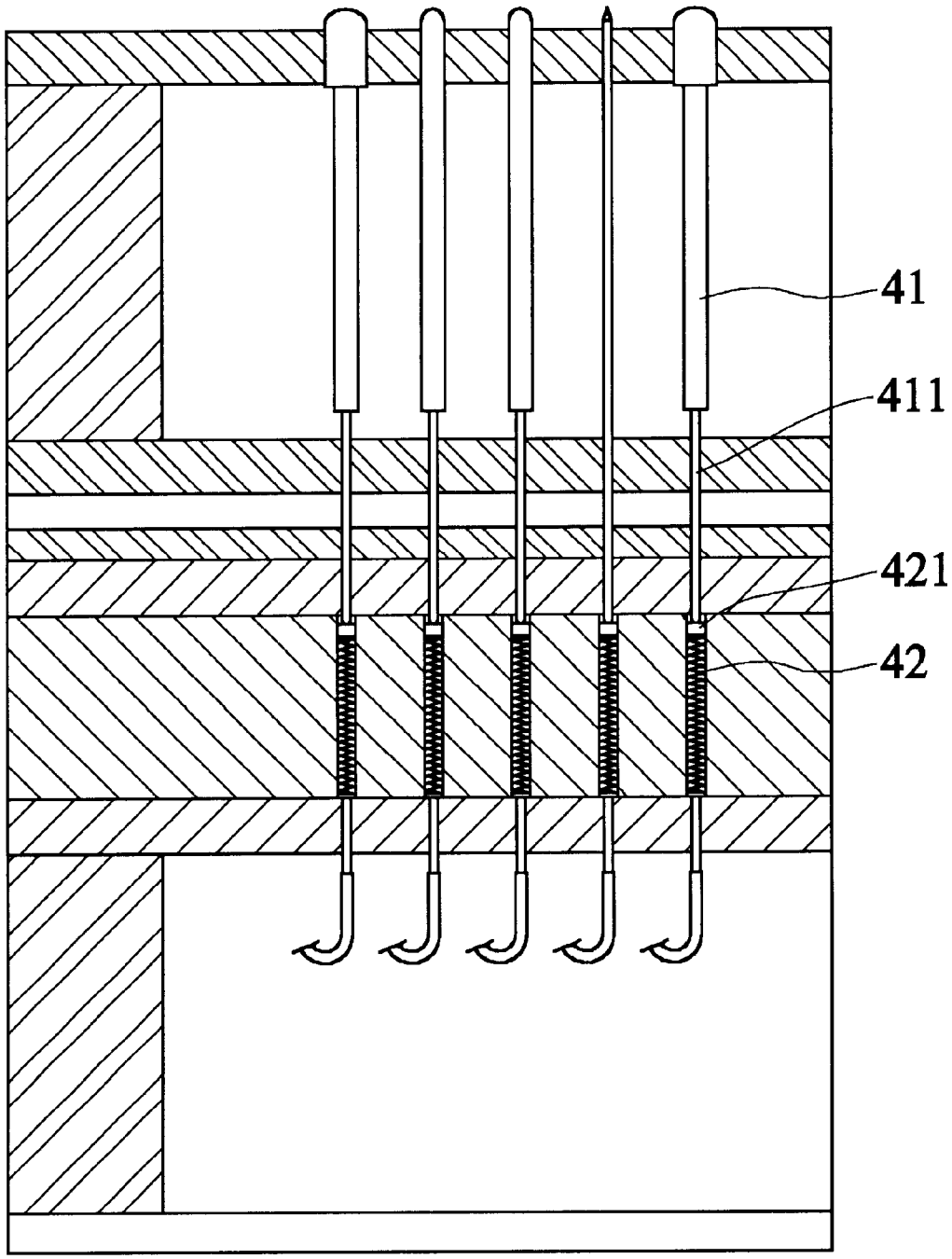
FIG. 4 is a cross-sectional view showing another embodiment of the invention.
Figure 6:
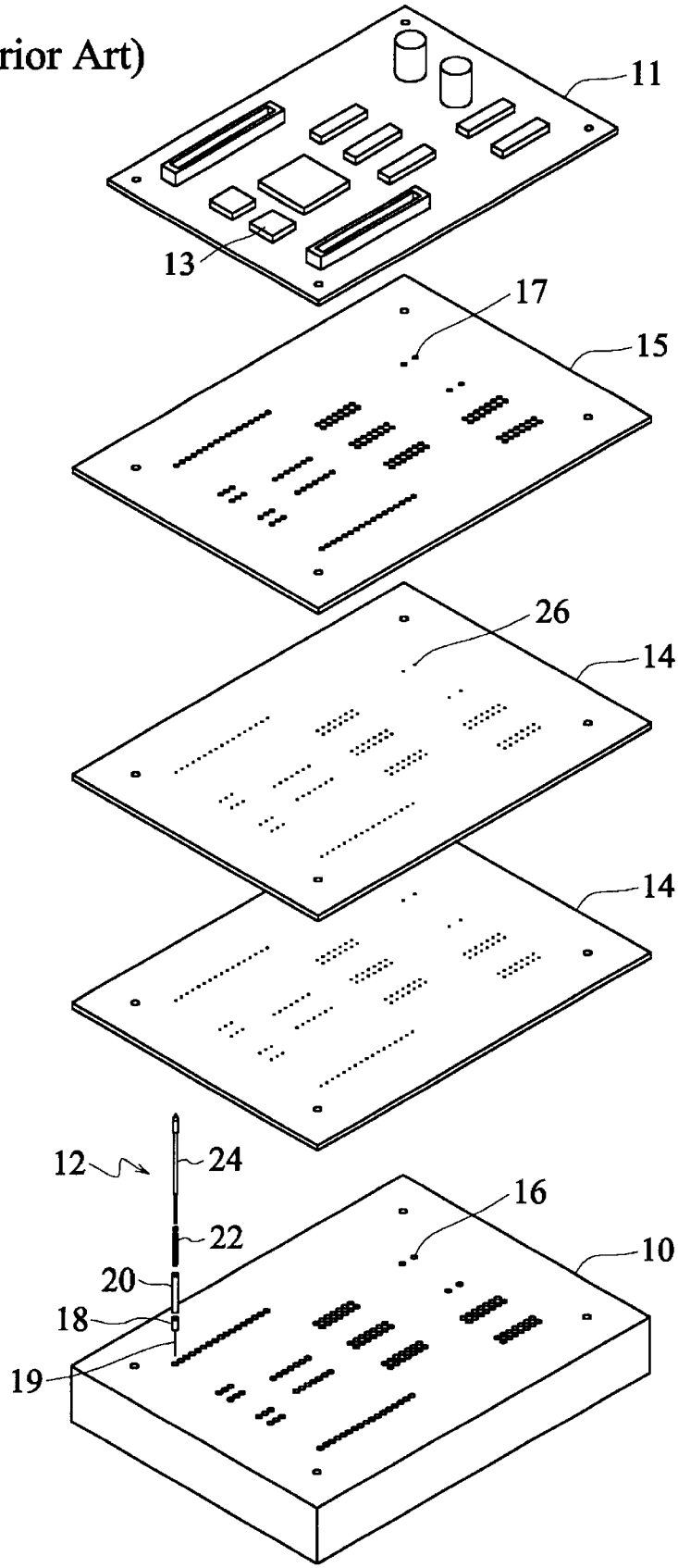
FIG. 6 (Prior Art)
FIG. 6 is an exploded view showing a conventional test jig.

Please refer to FIGS. 4 and 5, which show another embodiment of the invention. The support portion 421 of the resilient member 42 may be a conductive block separated from the resilient member 42 and located on the top end of the resilient member 42. The insertion portion 411 of the probe body 41 contacts the conductive block and signals can be transferred to the resilient member 42. Accordingly, the probe body 41 can be made relatively small and is free from deeply falling into the through hole formed in the resilient member 42.

According to the above-mentioned structure and method, the invention has the following advantages.

1. Using the structure in which the resilient member 42 is placed into the hole 111 of the pin board 11 and the probe body 41 is directly connected to the resilient member 42, the structure of the probe body 41 is simple. Furthermore, the probe body 41 may be made relatively thin and the manufacturing and testing costs may be effectively reduced.
2. Since the probe body 41 can be made relatively thin, the density of the to-be-tested devices can be increased.
3. Since the insertion portion 411 of the probe body 41 is aligned with the support portion 421 of the resilient member 42, the slanted probe body 41 can be proper guided.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A probe structure for testing a to-be-tested object having at least one to-be-tested device, the probe being inserted into a pin hole formed on a pin board and contacting the to-be-tested device, the probe structure comprising:

a probe body having an insertion portion and a head contacting the to-be-tested device; and a spring placed within the pin hole of the pin board and having a top end and a bottom end, the top end being formed with a support portion contacting the insertion portion of the probe body, the support portion being made of bottleneck-shaped, and being integrally formed with the spring by winding the spring, and having a diameter smaller than that of the probe body, when the probe body is inserted into the pin hole, so that the probe body can be elastically restored and properly guided.

* * * * *